US007918340B2

(12) United States Patent
Brennan et al.

(10) Patent No.: US 7,918,340 B2
(45) Date of Patent: Apr. 5, 2011

(54) BATTERY PACKAGING

(75) Inventors: Mark J. Brennan, Asheboro, NC (US); Steven D. Thomas, Abingdon, MD (US); Randall J. Binkley, Wildwood, MO (US); Scott W. Osiecki, Skaneateles, NY (US); Roy C. Park, Hanover (CA); Jeffrey D. Cooper, Asheboro, NC (US)

(73) Assignee: Eveready Battery Company, Inc., St. Louis, MO (US)

( * ) Notice: Subject to any disclaimer, the term of this patent is extended or adjusted under 35 U.S.C. 154(b) by 167 days.

(21) Appl. No.: 12/046,986

(22) Filed: Mar. 12, 2008

(65) Prior Publication Data

US 2009/0230018 A1 Sep. 17, 2009

(51) Int. Cl.
*B65D 85/00* (2006.01)

(52) U.S. Cl. ..... 206/703; 206/463; 206/470

(58) Field of Classification Search ..... 206/703, 206/463, 470, 471, 775, 806, 462, 476, 486
See application file for complete search history.

(56) References Cited

U.S. PATENT DOCUMENTS

| | | | | | |
|---|---|---|---|---|---|
| 2,983,368 | A | * | 5/1961 | Vander Lugt, Jr. | 206/470 |
| 3,408,758 | A | * | 11/1968 | Doring | 40/124.06 |
| 3,529,718 | A | | 9/1970 | Zaremski | |
| 3,743,084 | A | | 7/1973 | Douglas | |
| 3,840,114 | A | | 10/1974 | Sama | |
| 4,046,251 | A | * | 9/1977 | Bruml | 206/780 |
| 4,200,188 | A | | 4/1980 | Webinger | |
| 4,354,598 | A | * | 10/1982 | Schillinger | 206/462 |
| 4,549,654 | A | * | 10/1985 | Tiesman | 206/486 |
| 4,753,350 | A | * | 6/1988 | Seymour | 206/476 |
| 4,848,568 | A | | 7/1989 | Eckelman | |
| 5,117,976 | A | | 6/1992 | Whitt et al. | |
| 5,392,919 | A | * | 2/1995 | Passamoni | 206/576 |
| 5,485,919 | A | | 1/1996 | Samberg et al. | |
| 5,871,100 | A | | 2/1999 | Ward | |
| 5,957,358 | A | | 9/1999 | Getz et al. | |
| D433,628 | S | | 11/2000 | Tamura | |
| 6,364,115 | B1 | * | 4/2002 | Casanova et al. | 206/471 |
| D511,680 | S | * | 11/2005 | Zaborski | D9/415 |
| 7,392,906 | B2 | * | 7/2008 | Yu | 206/471 |

(Continued)

FOREIGN PATENT DOCUMENTS

EP 1 270 445 A1 1/2003

(Continued)

OTHER PUBLICATIONS

L.E.D. flashlight, web.archive.org/www.batterysavers.com, Jan. 2007 <<(http://web.archive.org/web/20070607201657/www.batterysavers.com/LED-Flashlight-Marine.html.>>.*

*Primary Examiner* — Ehud Gartenberg
*Assistant Examiner* — Ernesto A Grano
(74) *Attorney, Agent, or Firm* — Gregory J. Adams

(57) ABSTRACT

A display package includes a front cover having a first bulbous portion defining a flashlight retaining cavity. A display portion is adjacent the first bulbous portion. A container includes a first side wall and a second side wall, wherein the first side wall of the container is connected to the display package by a living hinge. At least one battery is disposed inside the container and at least one flashlight is disposed inside the first bulbous portion.

7 Claims, 11 Drawing Sheets

U.S. PATENT DOCUMENTS

| | | | | |
|---|---|---|---|---|
| D584,138 | S * | 1/2009 | Lafortezza et al. | D9/415 |
| D584,606 | S * | 1/2009 | Wintmolders et al. | D9/415 |
| 7,621,405 | B2 * | 11/2009 | Schweitzer et al. | 206/703 |
| 2003/0034274 | A1 | 2/2003 | Morita et al. | |
| 2007/0019402 | A1 * | 1/2007 | Dalton et al. | 362/157 |
| 2007/0206385 | A1 * | 9/2007 | Opolka | 362/394 |
| 2008/0143464 | A1 * | 6/2008 | Opolka | 335/205 |

FOREIGN PATENT DOCUMENTS

| | | |
|---|---|---|
| JP | 5914271 | 8/1984 |
| JP | 11124130 | 5/1999 |

* cited by examiner

BATTERY PACKAGING

FIELD OF THE INVENTION

The present invention relates to packaging, and in particular to packaging for batteries.

BACKGROUND OF THE PRESENT INVENTION

Electrochemical cells (i.e., batteries) are commonly employed to supply voltage for electrically operated devices, particularly for portable electrically operated devices. Currently, a number of popular alkaline cells of the generally cylindrical shape are commercially available in industry-recognized, standard sizes, including D-, C-, AA- and AAA-size cells, as well as other sizes and configurations.

Heretofore, batteries have been shipped and displayed in stores in battery packages having a cardboard backing and a battery receptacle portion holding the batteries. The battery packages are shipped in one container, which is later discarded and stocked on a shelf for display.

Accordingly, an improved manner of displaying the battery packages is desired.

SUMMARY OF THE INVENTION

In one aspect of the present invention, a battery package includes a front cover having first and second sides, and a first bulbous portion defining a cavity. A display portion is adjacent the first bulbous portion. A second bulbous portion is overlying the display portion and has a first side and a second side, wherein the first side of the second bulbous portion is integrally connected with the front cover by a hinge and the second side of the second bulbous portion is detachably connected to the front cover.

In another aspect of the present invention, a display package includes a front cover having a first bulbous portion defining a flashlight retaining cavity. A display portion is adjacent the first bulbous portion. A battery-retaining carton includes a first side wall, a forward wall, and a second side wall, wherein the battery-retaining carton is adjacent the display portion. At least one battery is disposed inside the carton.

In yet another aspect of the present invention, a display package includes a front cover having a first bulbous portion defining a flashlight retaining cavity. A display portion is adjacent the first bulbous portion. A container includes a first side wall and a second side wall, wherein the first side wall of the container is connected to the display package by a living hinge. At least one battery is disposed inside the container and at least one flashlight is disposed inside the first bulbous portion.

These and other features, advantages, and objects of the present invention will be further understood and appreciated by those skilled in the art by reference to the following specification, claims, and appended drawings.

DETAILED DESCRIPTION OF PREFERRED EMBODIMENTS

For purposes of description herein the terms "upper", "lower", "right", "left", "rear", "front", "vertical", "horizontal" and derivatives thereof shall relate to the invention as oriented in FIG. 1A. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
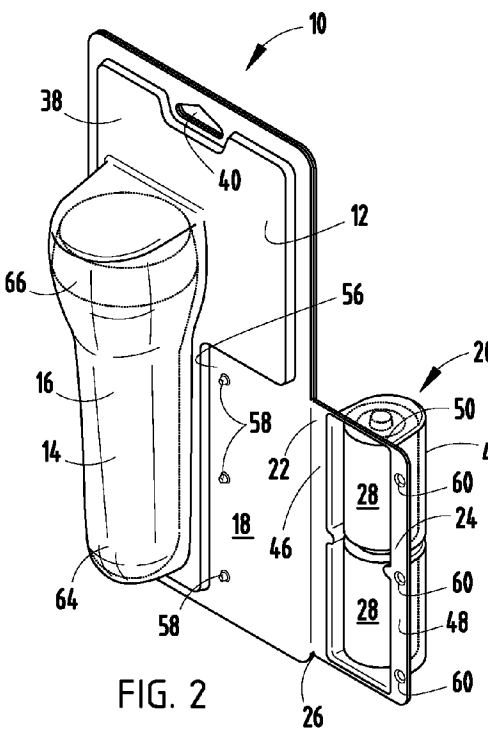
FIG. 2 is top perspective view of the display package with the container open.
Figure 1:
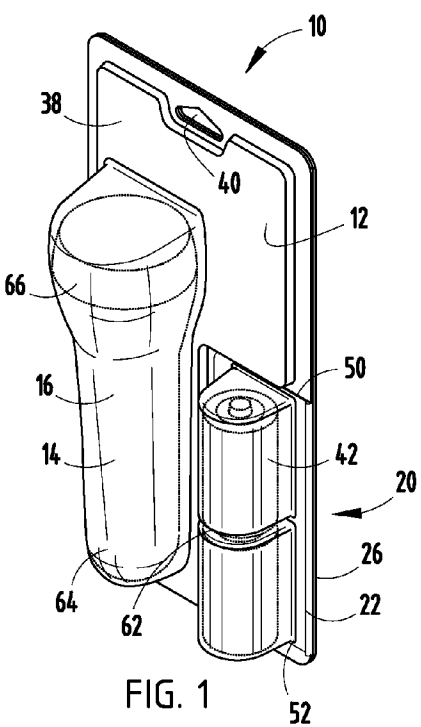
FIG. 1 is top perspective view of one embodiment of a display package of the present invention.
Figure 4:
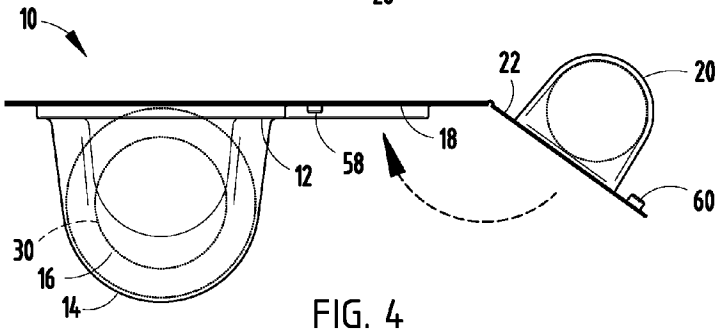
FIG. 4 is a top elevational view of the display package with the container partially open.
Figure 6:
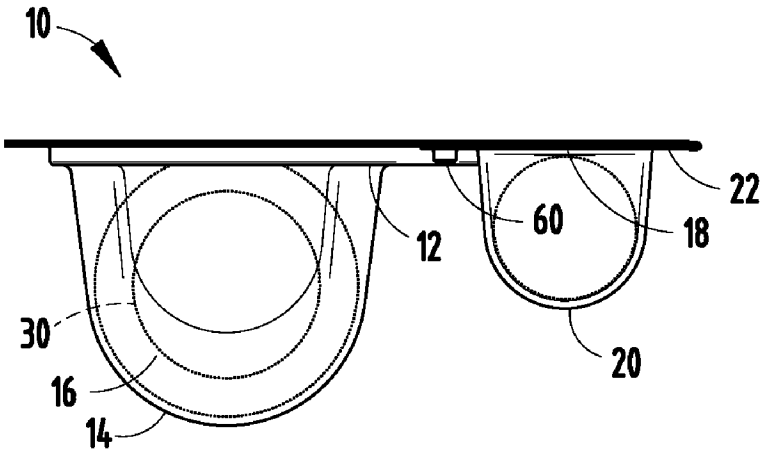
FIG. 6 is a top elevational view of the display package with the container closed.
Figure 5:
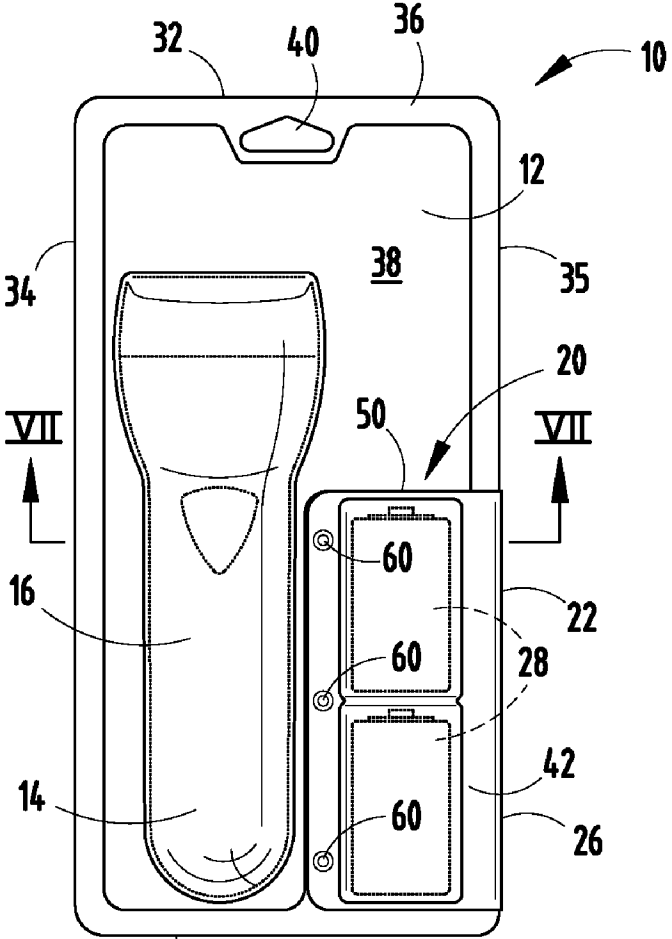
FIG. 5 is a front elevational view of the display package with the container closed.
Figure 7:
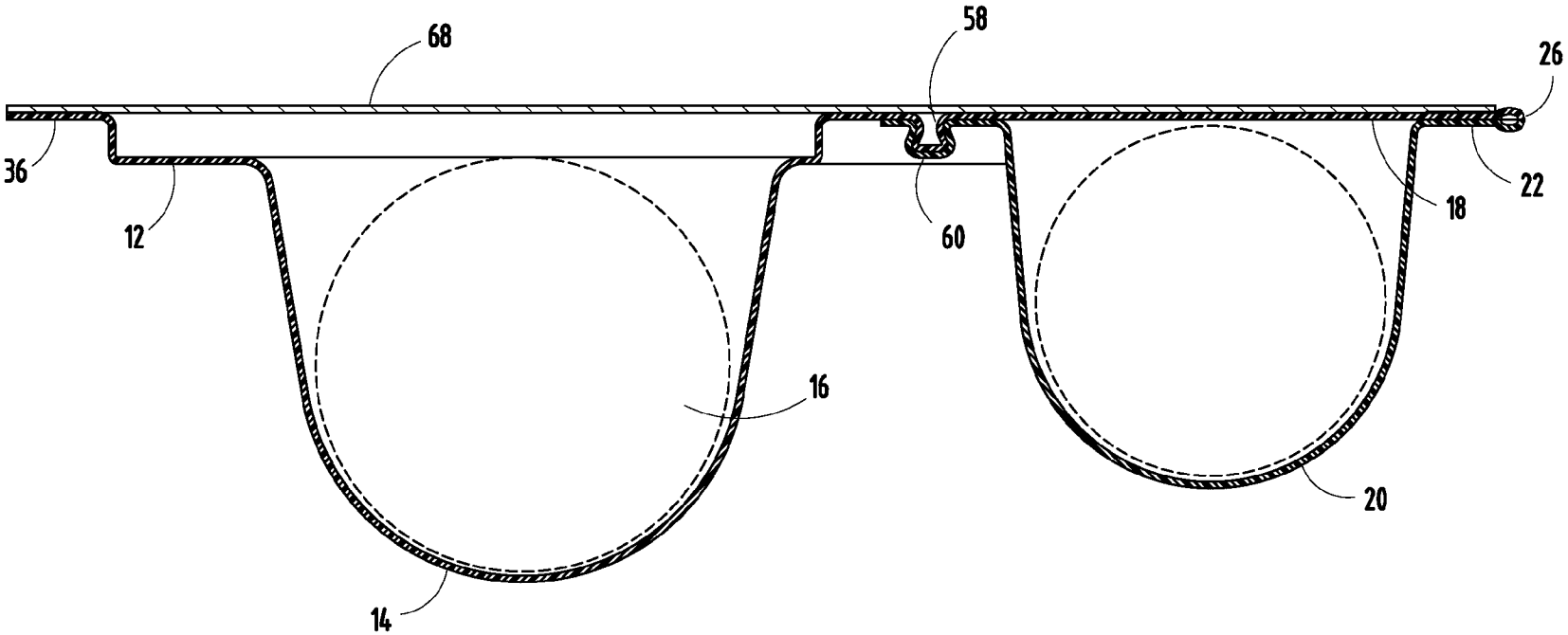
FIG. 7 is a top elevational cross-sectional view taken at line VII-VII of FIG. 5.
Figure 9:
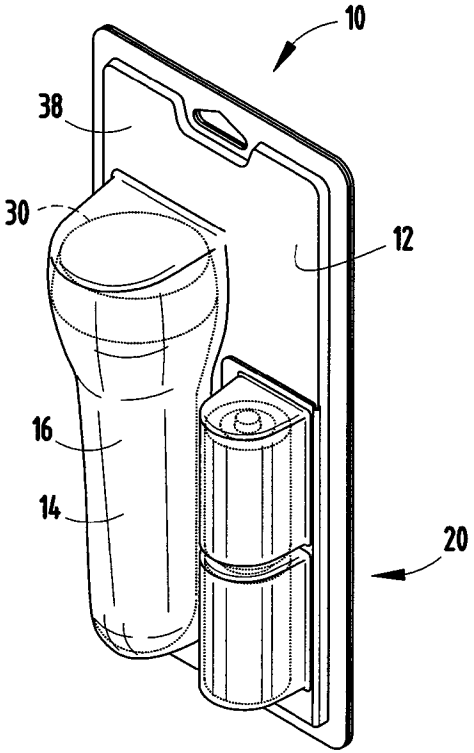
FIG. 9 is top perspective view of another embodiment of a display package of the present invention.
Figure 8:
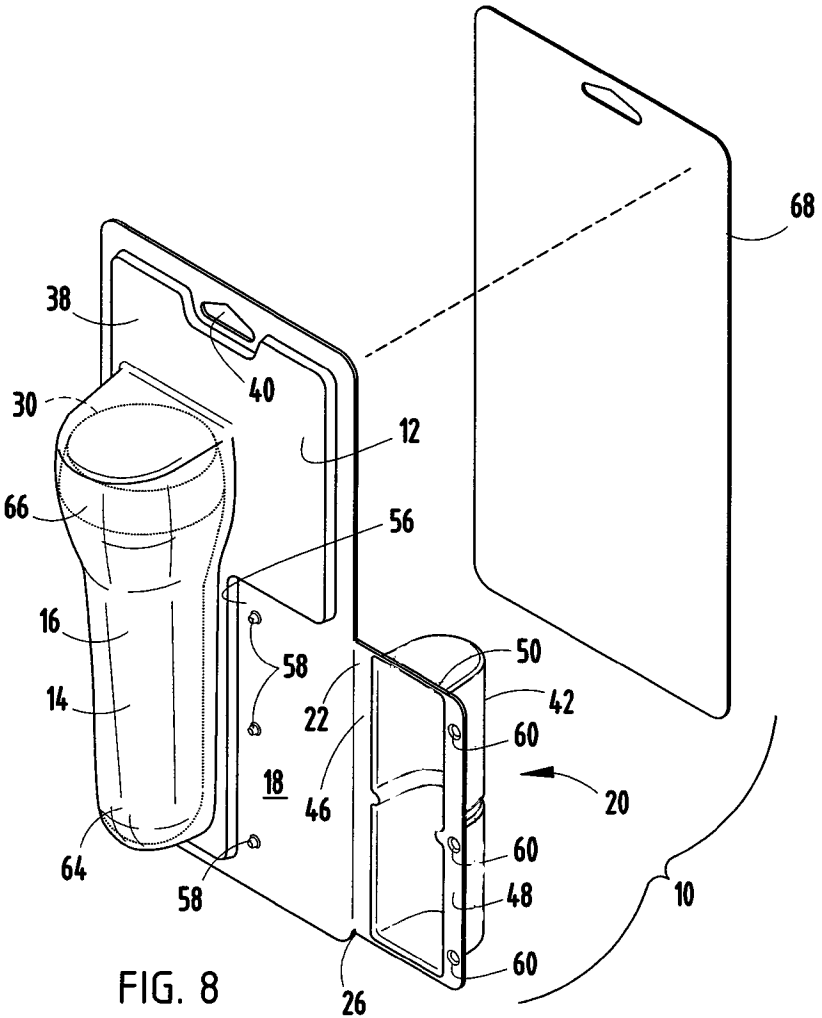
FIG. 8 is top perspective view of the display package prior to connection with the wood fiber backing.

Referring to FIGS. 1 and 2, the reference numeral 10 generally defines a display package having a front cover 12 with a first bulbous portion 14 defining a flashlight retaining cavity 16.

A display portion 18 is adjacent the first bulbous portion 14. A container 20 includes a first side 22 and a second side 24, wherein the first side 22 of the container 20 is connected to the display package 10 by a living hinge 26. At least one battery 28 is disposed inside the container 20 and at least one flashlight 30 is disposed inside the first bulbous portion 14.

Figure 3:
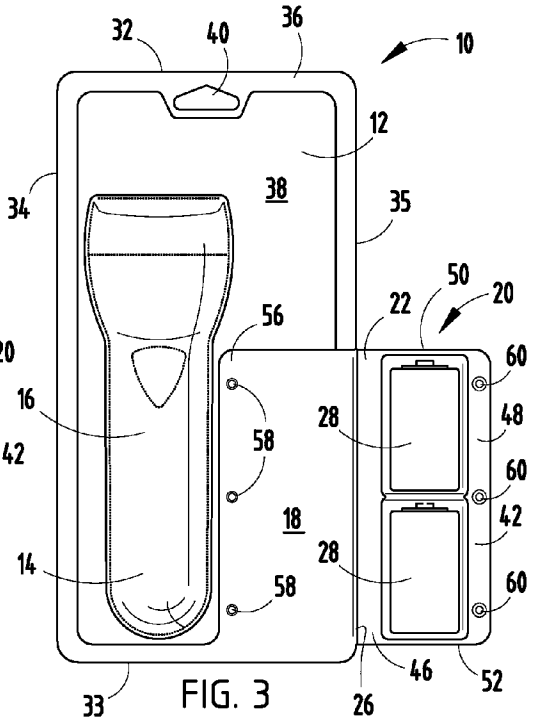
FIG. 3 is a front elevational view of the display package with the container open.

Referring again to FIGS. 1-3, the display package 10 includes a top edge 32, a bottom edge 33, and first and second side edges 34, 35. A rim 36 extends around the perimeter of the front cover 12 adjacent each of the top edge 32, bottom edge 34 and first and second sides 22, 24. A platform 38 is adjacent the rim 36, but the planar extent of the platform 38 is juxtaposed a predetermined space forward of the rim 36. It is also conceived that the platform 38 could be recessed a predetermined distance below the rim 36. The platform 38 provides additional structural rigidity to the display package 10 and can take a variety of shapes. A hanger slot 40 is disposed near the top of the front cover 12 between the top edge 32 and the platform 38. The container 20 may be an arcuately-shaped hinged bulbous portion 42 as shown in FIGS. 1 through 16, or may be a rectangularly-shaped carton 44 as shown in FIGS. 17 through 26. In either instance, the container 20 is designed to carry and retain accessories or a power source, such as batteries 28.

The batteries 28 can include electrochemical cells for supplying voltage to battery powered devices. The batteries 28 can include any alkaline or lithium cells of the generally cylindrical shape that are commercially available in industry-recognized, standard sizes, including D, C, AA, AAA and AAAA cells, as well as other sizes and configurations (e.g., 9 volt batteries). Alternatively, disc-shaped batteries 28 commercially available for small electrically operated devices, such as hearing aids, could be used.

As shown in FIGS. 1-4, the hinged bulbous portion 42 includes a first side flange 46, a second side flange 48 and top and bottom edges 50, 52. The hinged bulbous portion 42 is connected to the front cover 12 by the living hinge 26. More specifically, the living hinge 26 is connected to the first side flange 46 of the hinged bulbous portion 42 and one of either the first side 22 of the front cover 12, as shown in FIGS. 1-8, or the platform 38, as shown in FIGS. 9-16.

Referring again to FIGS. 1-4, during construction of the display package 10, a blank, flat stock, moldable plastic member is stamped or otherwise formed into the front cover 12 and hinged bulbous portion 42. During construction, the hinged bulbous portion 42 generally projects in a direction opposite that of the fixed bulbous portion 14. The living hinge 26 which, in the embodiment illustrated in FIGS. 1-8, connects the first side flange 46 of the hinged bulbous portion 42 to the first side 22 of the front cover 12 allows the hinged bulbous portion 42 to rotate about the first side flange 46 of the hinged bulbous portion 42 such that the second side flange 48 can be rotated into abutting alignment with an interior area 56 (FIG. 3) of the front cover 12. Connecting lugs 58 extend upwardly from the front cover 12 and are designed for engagement with receiving apertures 60 on the second side flange 48 of the hinged bulbous portion 42. Accordingly, the hinged bulbous portion 42 may be rotated about the living hinge 26 until the receiving apertures 60 engage the connection lugs 58 providing an interference fit which secures the second side flange 48 of the hinged bulbous portion 42 into connected position adjacent to the first bulbous portion 14. After the connection lugs 58 are secured to the receiving apertures 60, both the fixed and hinged bulbous portions 14, 42 project in a forward direction. It is contemplated that the receiving apertures 60 could also be formed on the front cover 12 and that the connection lugs 58 could be on the second side flange 48 of the hinged bulbous portion 42. Additionally, the second side flange 48 of the hinged bulbous portion 42 could also be glued, sealed, stapled, etc.

As shown in FIG. 1, the hinged bulbous portion 42 also includes a spacing indent 62. The spacing indent 62 separates two adjacent batteries 28 and assists in holding the batteries 28 in place inside the hinged bulbous portion 42. The fixed bulbous portion 14 includes a lower handle area 64 and an upper light source area 66 that snugly conforms to the exterior shape of a typical flashlight 30 when disposed inside the first bulbous portion 14. A wood fiber backing 68 is disposed on a rear side of the front cover 12 and is connected to the rear side of the front cover 12 near the rim 36.

Figure 11:
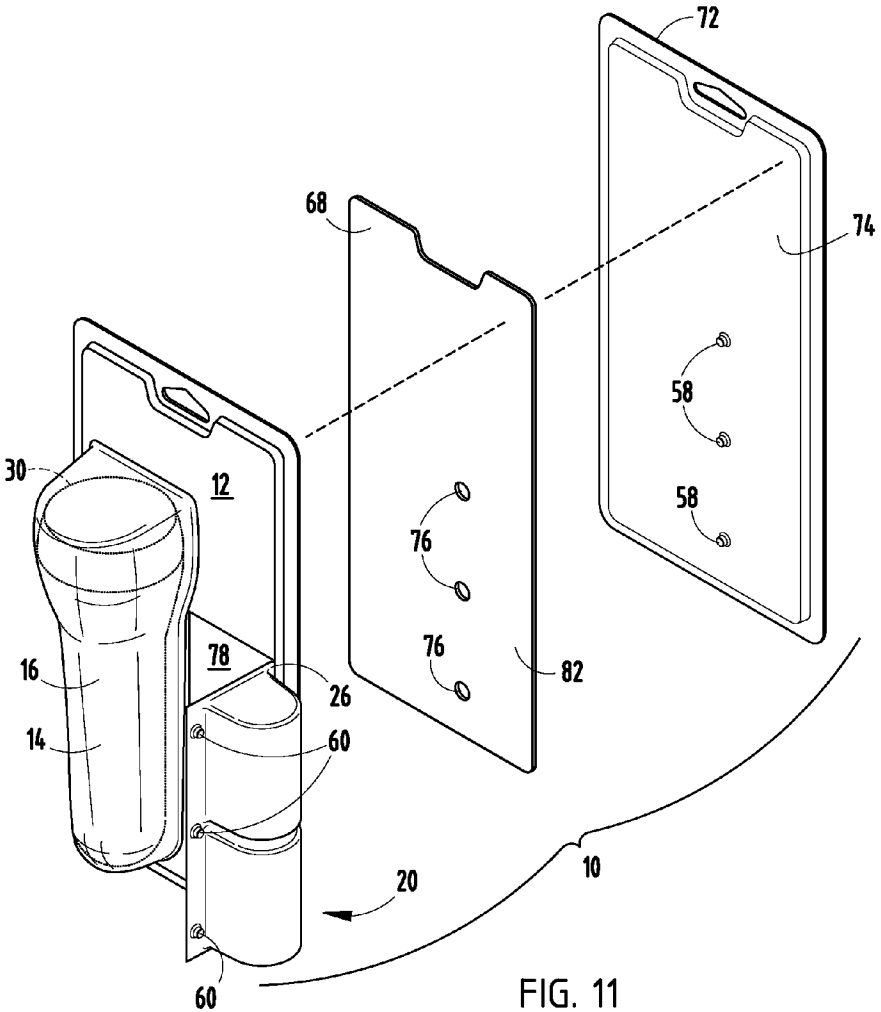
FIG. 11 is an exploded perspective view of the display package of FIG. 10 with the container open.
Figure 10:
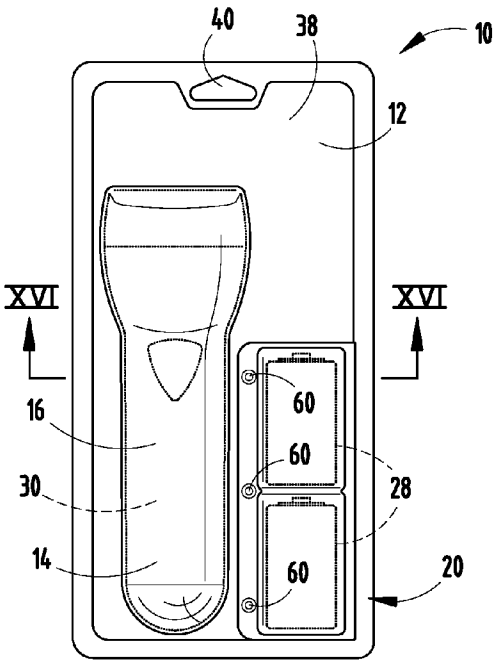
FIG. 10 is a front elevational view of the display package of FIG. 9.
Figure 14:
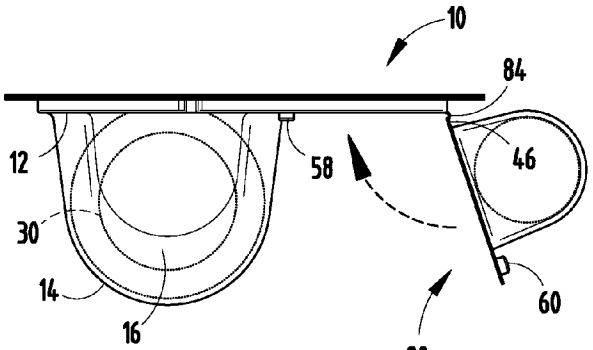
FIG. 14 is a top elevational view of the display package of FIG. 14 with the container partially open.
Figure 15:
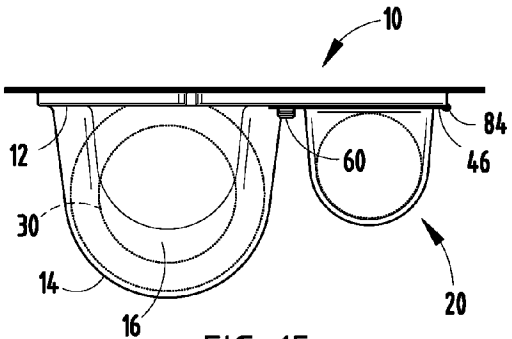
FIG. 15 a top elevational view of the display package of FIG. 14 with the container closed.
Figure 13:
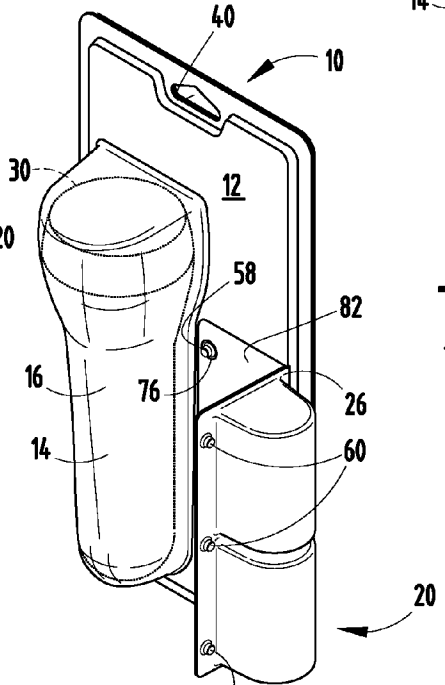
FIG. 13 is top perspective view of the display package of FIG. 10 with the container open.
Figure 12:
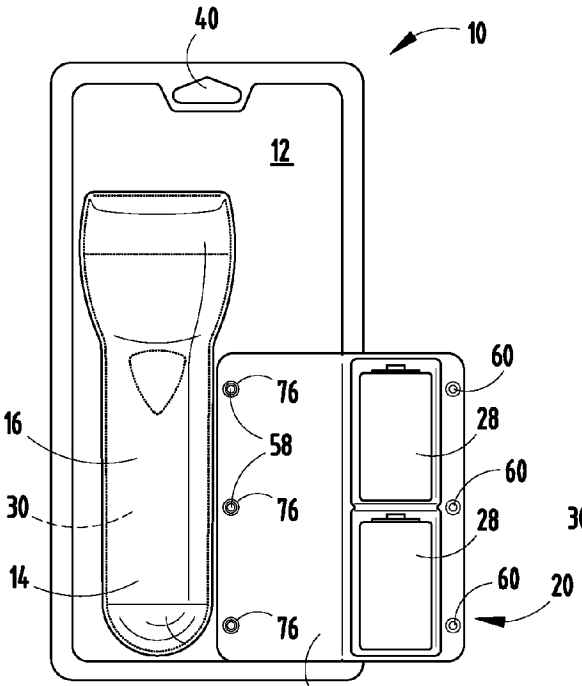
FIG. 12 is a front elevational view of the display package of FIG. 10 with the container open.
Figure 16:
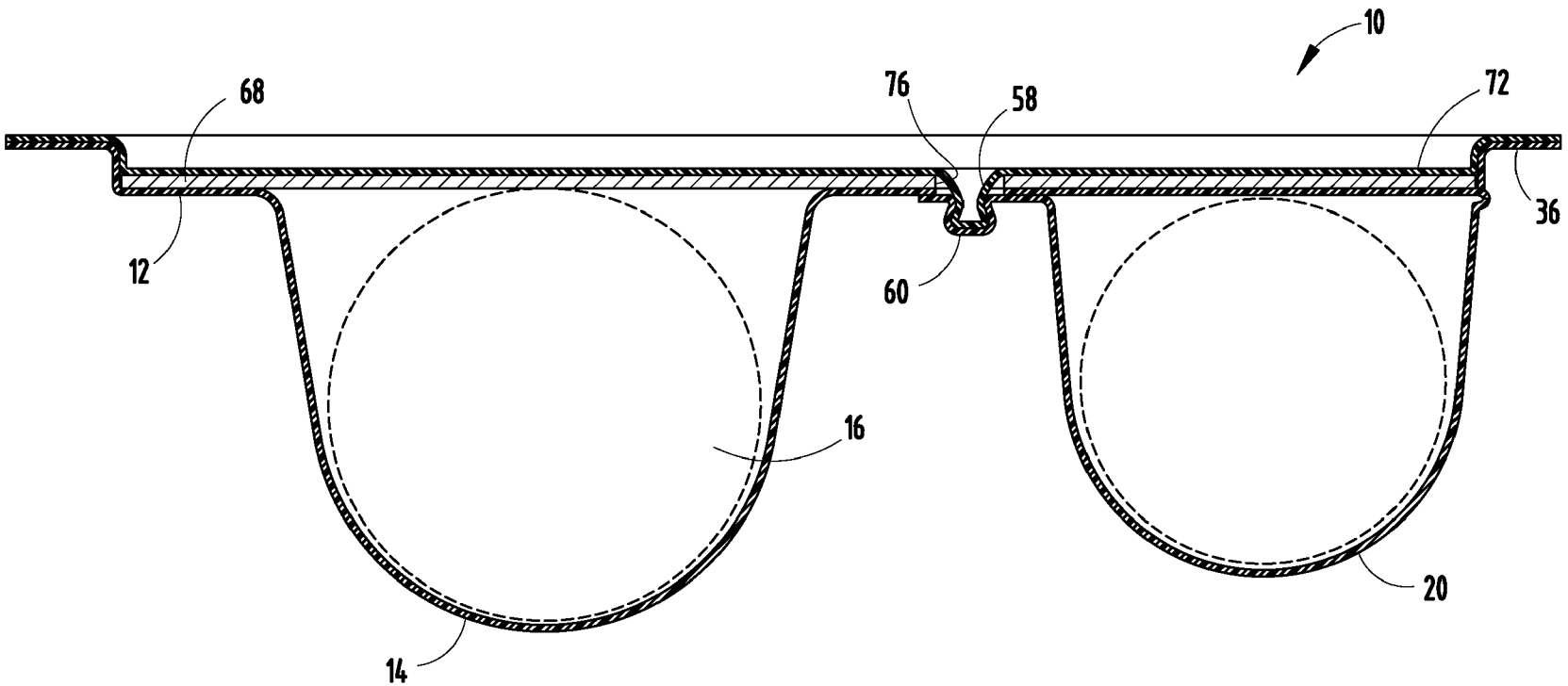
FIG. 16 is a top elevational cross-sectional view of the display package taken at line XVI-XVI of FIG. 10.
Figure 19:
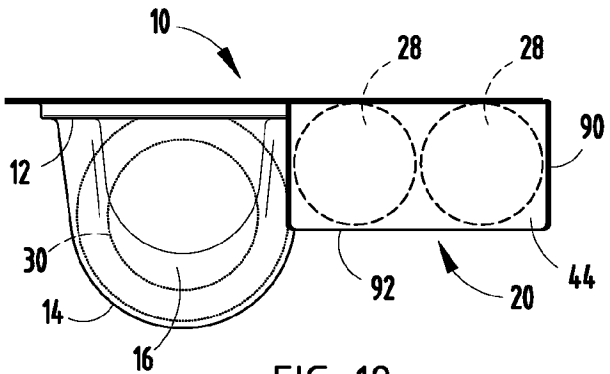
FIG. 19 is a top elevational view of the display package of FIG. 17.
Figure 18:
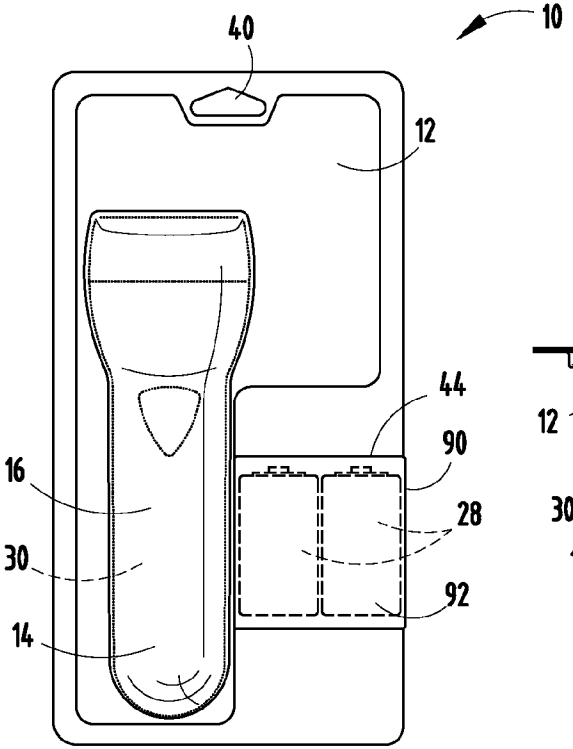
FIG. 18 is a front elevational view of the display package of FIG. 17.
Figure 17:
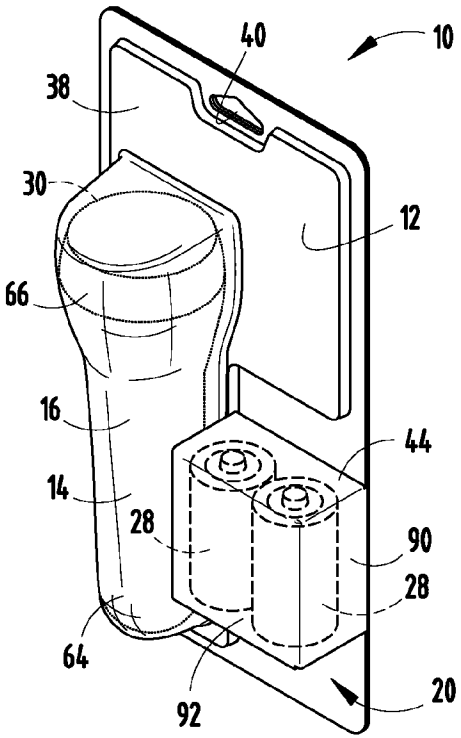
FIG. 17 is a top perspective view of another embodiment of a display package of the present invention.
Figure 22:
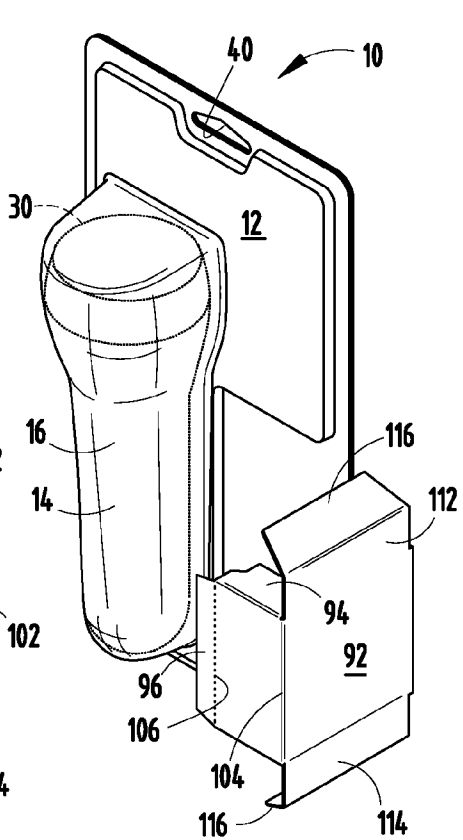
FIG. 22 is a front perspective view of the display package of FIG. 17 during folding of the carton.
Figure 21:
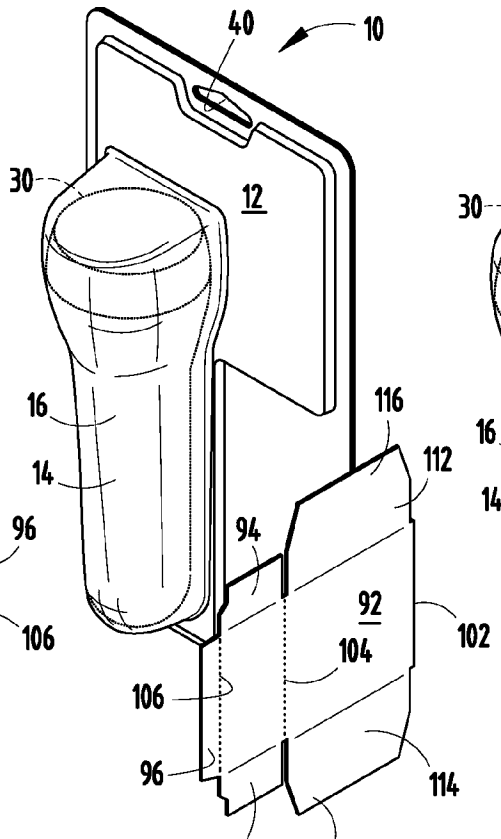
FIG. 21 is a front perspective view of the display package of FIG. 17 during folding of the carton.
Figure 20:
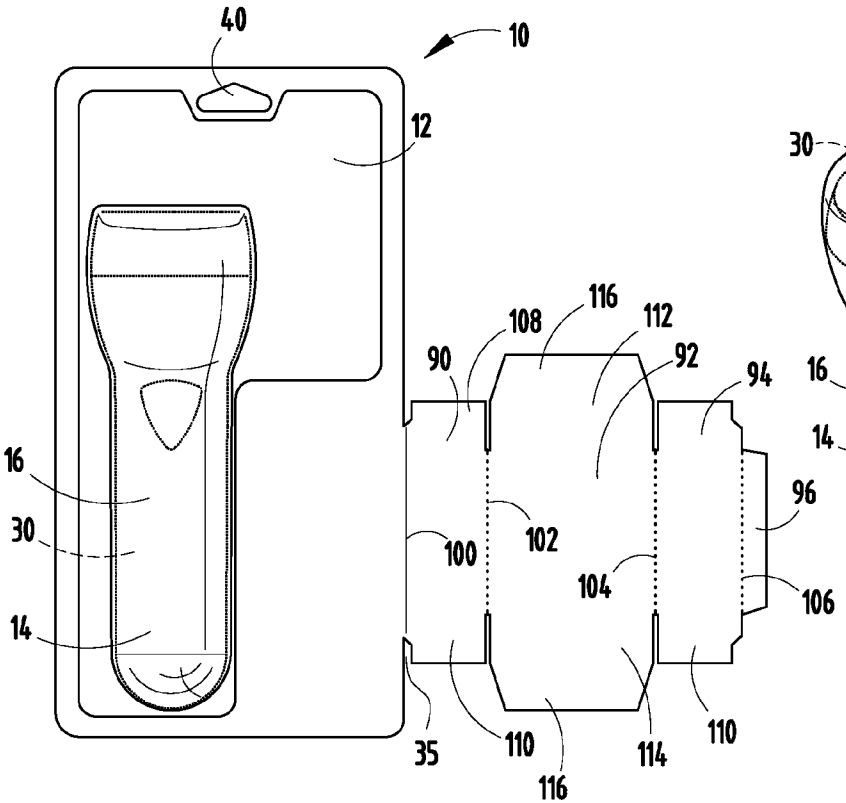
FIG. 20 is a front elevational view of the display package of FIG. 17 prior to folding of the carton.
Figure 24:
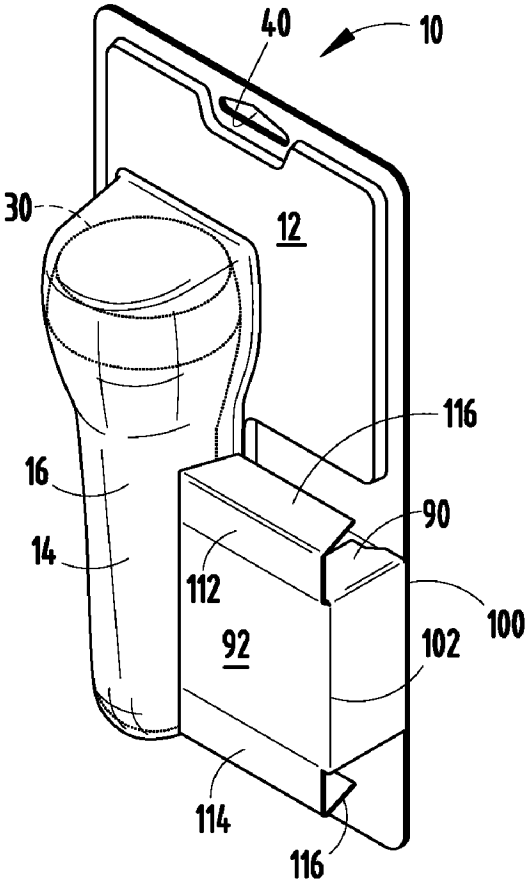
FIG. 24 is a front perspective view of the display package of FIG. 17 during folding of the carton.
Figure 23:
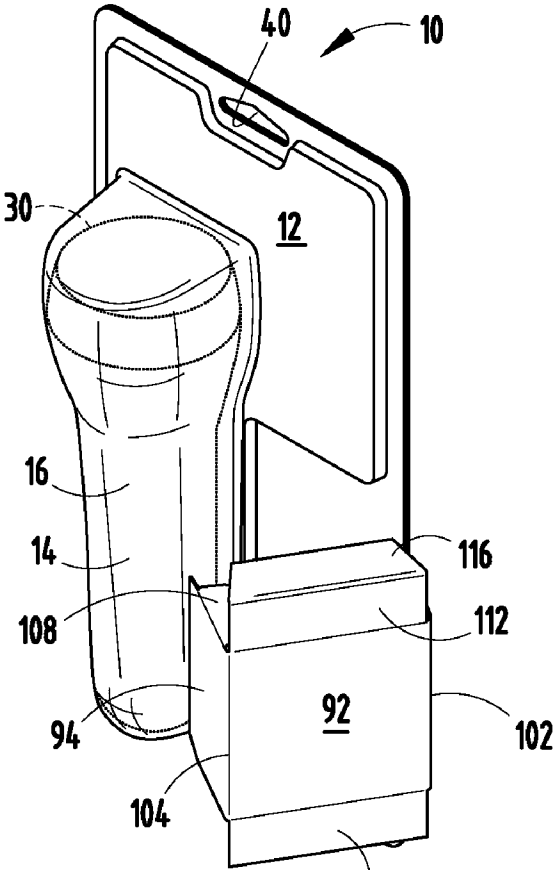
FIG. 23 is a front perspective view of the display package of FIG. 17 during folding of the carton.

Referring now to the embodiment illustrated in FIGS. 9-16, the wood fiber backing 68 may be disposed between a rear cover 72 and the front cover 12. More specifically, the wood fiber backing 68 could be sandwiched between the platform 38 of the front cover 12 and a rear platform 74 disposed on the rear cover 72. In this instance, the connection lugs 58 extend forwardly from the rear platform 74 through backing slots 76 that extend through the wood fiber backing 68. When assembled, the connection lugs 58 extend through the backing slots 76 so that the receiving apertures 60 disposed on the second side flange 48 of the hinged bulbous portion 42 can engage the connection lugs 58. The receiving apertures 60 receive the connection lugs 58 when the hinged bulbous portion 42 is closed onto the front cover 12 of the battery packaging 10. In addition, in this instance, the display portion 18 defines an enlarged opening 78 (FIG. 11). The wood fiber backing 68 provides a battery abutment area 82 adjacent to the backing slots 76. Accordingly, when batteries 28 are disposed inside the hinged bulbous portion 42, the batteries 28 are disposed between the hinged bulbous portion 42 and the abutment area 82 of the wood fiber backing 68. Also, in the embodiment shown in FIGS. 9-16, a living hinge 84 is disposed on the platform 38 of the front cover 12 and connects the first side flange 46 of the hinged bulbous portion 42 to the platform 38 of the front cover 12. All other similar features of this embodiment that have not been discussed in detail are similar to those features disclosed above with respect to the first embodiment.

Referring now to FIGS. 17-26, the display package 10 includes a container 20 in the form of a carton 44. The carton 44 extends from one of the front cover 12 or the wood fiber backing 68. The carton 44 includes a first side wall 90, a forward wall 92, and a second side wall 94. The second side wall 94 includes a sealing flap 96.

In the illustrated embodiment of FIGS. 20-25, when the carton 44 extends from the front cover 12, a first fold 100 is made at a junction of the first side wall 90 and the second side edge 35 of the front cover 12. A second fold 102 is made at the junction between the first side wall 90 and the forward wall 92, and a third fold 104 is made at the junction between the forward wall 92 and the second side wall 94. In addition, a fourth fold 106 is made between the second side wall 94 and the sealing flap 96. The sealing flap 96 may be connected to the front cover 12 in one of several ways including, but not limited to sealing, adhering, or by interference fit. Additionally, each of the first and second side walls 90, 94 includes top and bottom flaps 108, 110 designed to abut top and bottom flaps 112, 114 of the forward wall 92 when the carton 44 is in a closed position. The top flap 112 and the bottom flap 114 of the forward wall 92 also include a tab 116 designed to abut the front cover 12 of the display package 10. It is conceived that the top and bottom flaps 112, 114 of the forward wall 92 may be adhered or sealed to the top and bottom flaps 108, 110 of the first side wall 90 and the second side wall 94. In this instance, one or more batteries 28 are disposed in the carton 44 and may be removed upon opening of the top flap 112 of the forward wall 92.

Figure 26:
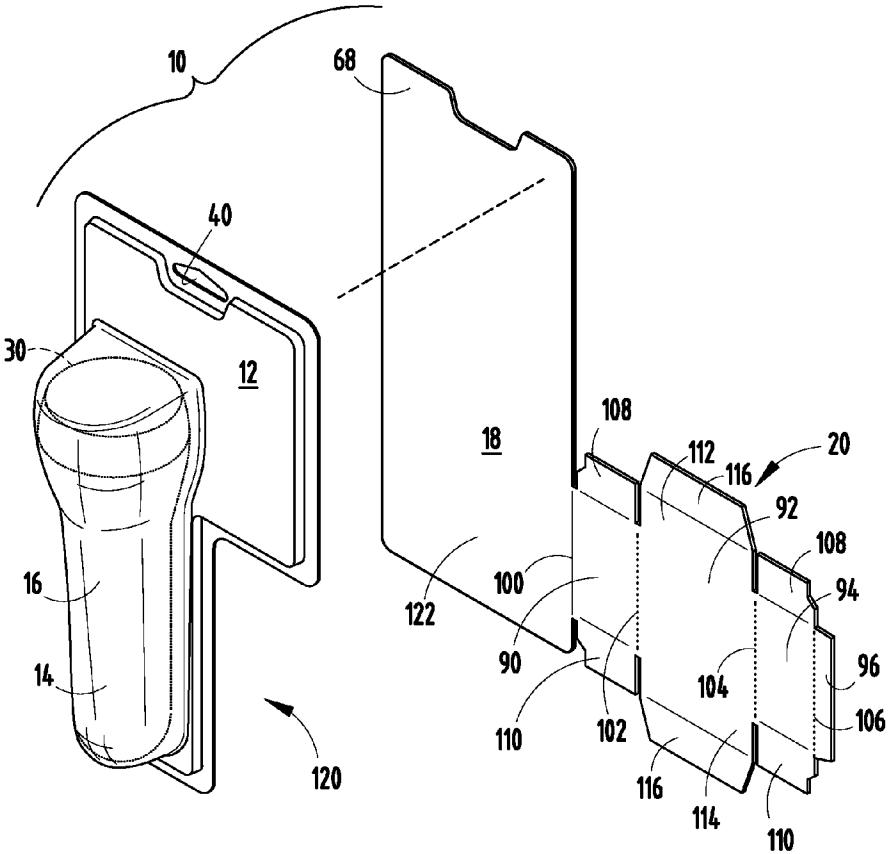
FIG. 26 is a top perspective view of the display package with the carton connected to the wood fiber backing.
Figure 25:
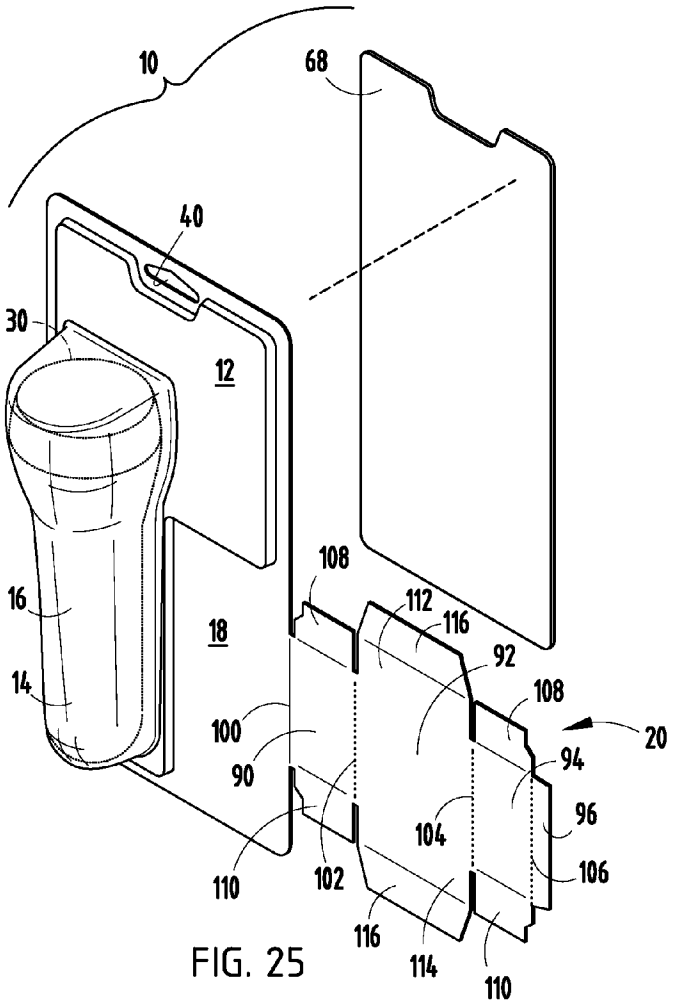
FIG. 25 is a top perspective view of a display package with the carton connected to the front cover.

As shown in FIG. 26, in the event that the carton 44 extends from the wood fiber backing 68, the carton 44 will extend around the front cover 12 in the manner similar to that described above (relating to the carton 44 being integral with the front cover 12). In this instance, it is contemplated that the front cover 12 may include a recessed area 120 that does not overlap the wood fiber backing 68. The recessed area 120 is part of the display portion 18 such that any batteries 28 disposed in the carton 44 would contact an abutment area 122 on the wood fiber backing 68 rather than contacting a portion of the front cover 12. It is also conceived that the front cover 12 may completely cover the wood fiber backing 68 such that the batteries 28 would directly abut the front cover 12 rather than the wood fiber backing 68. All other similar features of this embodiment that have not been discussed in detail are similar to those features disclosed above with respect to the first and second embodiment.

While the invention has been described in detail herein in accordance with certain preferred embodiments thereof, many modifications and changes therein may be affected by those skilled in the art without departing from the spirit of the invention. Accordingly, it is our intent to be limited only by the scope of the appending claims and not by way of the details and instrumentalities describing the embodiments shown herein.

What is claimed is:

1. A display package comprising:

a front cover having first and second side edges, a front side, a rear side and a first bulbous portion defining a cavity formed on the front side, the bulbous portion having a front side and a rear side;

a back cover connected to a rear side of the front cover;

a display portion on the front side of the front cover adjacent the first bulbous portion; and a container overlying the display portion and having a first side and a second side, the first side of the container is integrally connected with front side of the front cover by a hinge, the container having a closed position such that the first side of the container and the front side of the bulbous portion face frontward and an open position such that the first side of the container faces rearward and the front side of the bulbous portion faces frontward.

2. The display package of claim 1, further comprising:

a flashlight disposed in the first bulbous portion and at least one battery disposed in the container.

3. The display package of claim 1, wherein:

the front cover includes a platform portion having a top edge, a bottom edge and first and second side edges and wherein the first side of the container is integrally connected with the front cover at the first side edge of the platform portion.

4. The display package of claim 3, further comprising:

a flashlight disposed in the first bulbous portion and at least one battery disposed in the container.

5. The display package of claim 4, wherein:

the display portion defines an opening in the front cover.

6. The display package of claim 1, further comprising:

a wood fiber backing disposed between the front cover and the rear cover.

7. The display package of claim 1, the cavity of the first bulbous portion containing a first object removable rearward through the backside of the first bulbous portion and the backside of the cover, the container containing a second object removable from the front side of the cover on the container being in the open position.

* * * * *